US005961396A

United States Patent [19]

Morell et al.

[11] Patent Number: 5,961,396

[45] **Date of Patent: *Oct. 5, 1999**

[54] GOLF CLUB SHAFT

[75] Inventors: Joseph Morell; Jean-Marc Banchelin, both of Annecy Le Vieux, France

[73] Assignee: Taylor Made Golf Company, Inc., Carlsbad, Calif.

[ * ] Notice: This patent is subject to a terminal disclaimer.

[21] Appl. No.: 09/088,081

[22] Filed: Jun. 1, 1998

Related U.S. Application Data

[60] Continuation of application No. 08/868,533, Jun. 4, 1997, Pat. No. 5,759,112, which is a division of application No. 08/039,567, May 11, 1993, Pat. No. 5,716,291.

[30] Foreign Application Priority Data

Dec. 5, 1990 [FR] France ..... 90 15388

[51] Int. Cl.[6] ..... A63B 53/10

[52] U.S. Cl. ..... 473/320; 473/323; 273/DIG. 7; 273/DIG. 23

[58] Field of Search ..... 473/316–323; 273/DIG. 7, DIG. 23

[56] References Cited

U.S. PATENT DOCUMENTS

| | | | |
|---|---|---|---|
| D. 93,756 | 11/1934 | Barnhart . | |
| 1,565,069 | 12/1925 | Edwards . | |
| 1,670,531 | 5/1928 | Cowdary . | |
| 1,688,473 | 10/1928 | Sippel . | |
| 2,040,540 | 5/1936 | Young . | |
| 2,050,554 | 8/1936 | Barnhart | 473/323 |
| 2,086,275 | 7/1937 | Lemmon . | |
| 2,220,852 | 11/1940 | Scott | 473/323 |
| 2,250,428 | 7/1941 | Vickery | 473/323 |
| 2,250,429 | 7/1941 | Vickery . | |
| 2,250,441 | 7/1941 | Vickery . | |
| 2,809,144 | 10/1957 | Grimes . | |
| 3,083,969 | 4/1963 | Bills | 473/294 |
| 3,764,137 | 10/1973 | Petro . | |
| 3,848,480 | 11/1974 | Oseroff | 473/301 |
| 4,131,701 | 12/1978 | Vanauken . | |
| 4,174,109 | 11/1979 | Gaiser | 473/204 |
| 4,319,750 | 3/1982 | Roy . | |
| 4,330,126 | 5/1982 | Rumble | 473/323 |
| 4,352,292 | 10/1982 | Madigosky | 73/575 |
| 4,414,363 | 11/1983 | Akita | 525/237 |
| 4,836,545 | 6/1989 | Pompa . | |
| 5,083,780 | 1/1992 | Walton et al. . | |
| 5,251,896 | 10/1993 | Gerlach | 473/317 |
| 5,716,291 | 2/1998 | Morell et al. . | |
| 5,759,112 | 6/1998 | Morell et al. . | |

FOREIGN PATENT DOCUMENTS

| | | |
|---|---|---|
| 800882 | 7/1936 | France . |
| 90 15388 | 12/1990 | France . |
| 52-13990 | 2/1977 | Japan . |
| 53-17884 | 5/1978 | Japan . |
| 59-133268 | 9/1984 | Japan . |
| 1-185274 | 7/1989 | Japan . |
| 256049 | 7/1989 | Japan . |
| 1-259879 | 10/1989 | Japan . |
| 2-98375 | 4/1990 | Japan . |
| 24144 | 10/1911 | United Kingdom . |
| 307468 | 4/1930 | United Kingdom . |
| 378295 | 8/1932 | United Kingdom . |
| 404995 | 1/1934 | United Kingdom . |
| 447496 | 5/1936 | United Kingdom . |
| 1159714 | 7/1969 | United Kingdom . |
| 2053698 | 2/1981 | United Kingdom . |

*Primary Examiner*—Jeanette Chapman
*Assistant Examiner*—Stephen L. Blau
*Attorney, Agent, or Firm*—Knobbe, Martens, Olson and Bear

[57] ABSTRACT

Tubular golf club shaft made from composite materials comprising layers of fibers impregnated with plastic resin and provided over its length with at least one are of enlargement (6) and or narrowing. The curve of generation of the internal diameter of the shaft as a function of its length beginning at the point of the smallest internal diameter and extending to at least one of the ends of the shaft incorporates at least one decreasing portion.

8 Claims, 7 Drawing Sheets

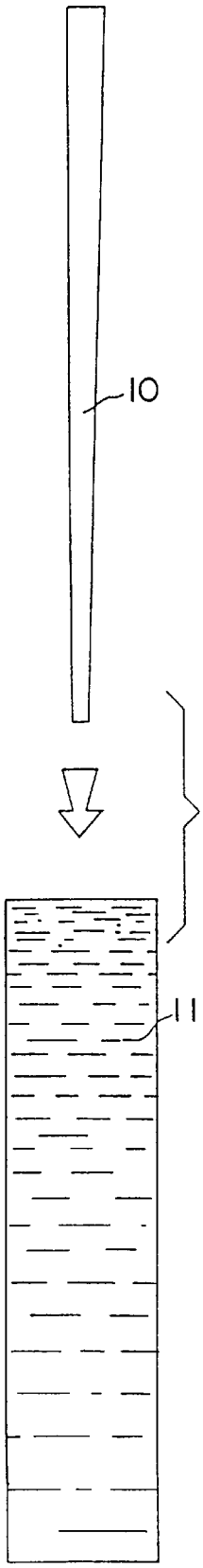
FIG. 14
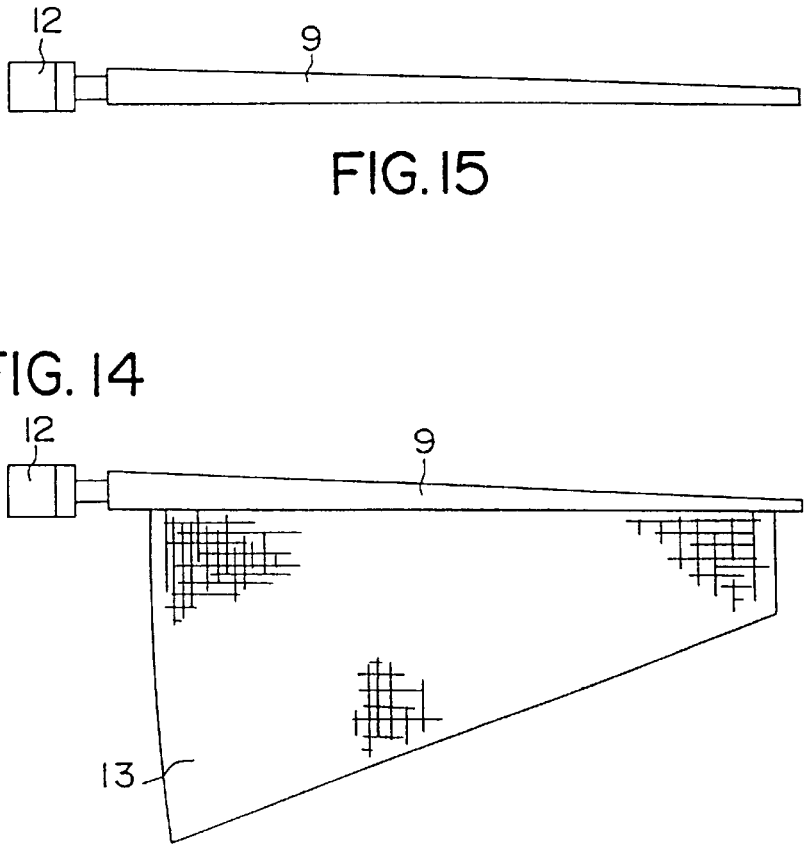
FIG. 15
FIG. 16

GOLF CLUB SHAFT

This application is a continuation of U.S. application Ser. No. 08/868,533, filed Jun. 4, 1997, which will issue on Jun. 2, 1998 as U.S. Pat. No. 5,759,112, which is a divisional of U.S. application Ser. No. 08/039,567, filed May 11, 1993, now U.S. Pat. No. 5,716,291, claiming priority from French Application 90-15388, filed Dec. 5, 1990.

FIELD OF THE INVENTION

The present invention relates to a golf club shaft made of composite materials, and in particular, a shaft having a complex shape.

BACKGROUND OF THE INVENTION

Conventionally-used golf club shafts are generally made of steel, metal alloys, or composite materials. They possess a slightly conical shape and continuous variation of their section, whose maximum dimension is measured at the grip, or handle, and the minimum dimension, at the neck, where the head of the club is attached. This remains the most widely-used shaft geometry.

If one wishes to vary the mechanical properties of the shaft, i.e., in particular, the moment of inertia and the elastic line under torsion and flection, the opportunities for such changes on these shafts are rather limited. The addition of inertia blocks or reinforcements at different places on the shaft is not a satisfactory solution, since one part of the club is made heavier, a generally undesirable effect. One example of an embodiment of this kind is given in Patent No. JP 1-159 879, which describes the fabrication of a shaft made of composite materials comprising reinforcement zones produced by adding pieces formed from layers of resin-impregnated fiber sheets to the body of the shaft. A second disadvantage of this construction arises from the lack of continuity of the fiber sheets at these reinforcement sites, thereby appreciably impairing the reproducibility of the mechanical properties from one shaft to another and thus limiting their use by professionals.

Similarly, Patent No. GB 256,049 describes a golf club fitted with a metal shaft on which flexible areas of contraction are produced so as to modify the curve of deformation under flection and thus, to improve the elastic response of the club. While flection properties are, in this case, controlled and optimized, the torsion properties, in particular, are poorly controlled, mainly because of the homogeneous, non-fibrous nature of the material used.

SUMMARY OF THE INVENTION

It is thus an object of the invention to remedy the above-mentioned disadvantages resulting mainly from the structure and the nature of the materials used, by proposing a golf club shaft incorporating a new design. To this end, the shaft according to the present invention is tubular and manufactured using essentially continuous layers of sheets of fibers impregnated with a plastic material. Said shaft is provided over its length with at least one area of enlargement and/or narrowing and is characterized by the fact that the curve of variation of the internal diameter of the shaft as a function of the length, beginning at the point of the smallest internal diameter, and extending toward at least one of the ends of the shaft, allows at least one decreasing portion.

BRIEF DESCRIPTION OF THE DRAWINGS

The invention will be better understood, and other advantages and its properties will more clearly emerge, from the embodiments described below and illustrated by the following drawings in which:

FIGS. 14 to 19 represent the various steps in an example of a process for fabrication of shafts according to the invention.

DETAILED DESCRIPTION

Figure 1:
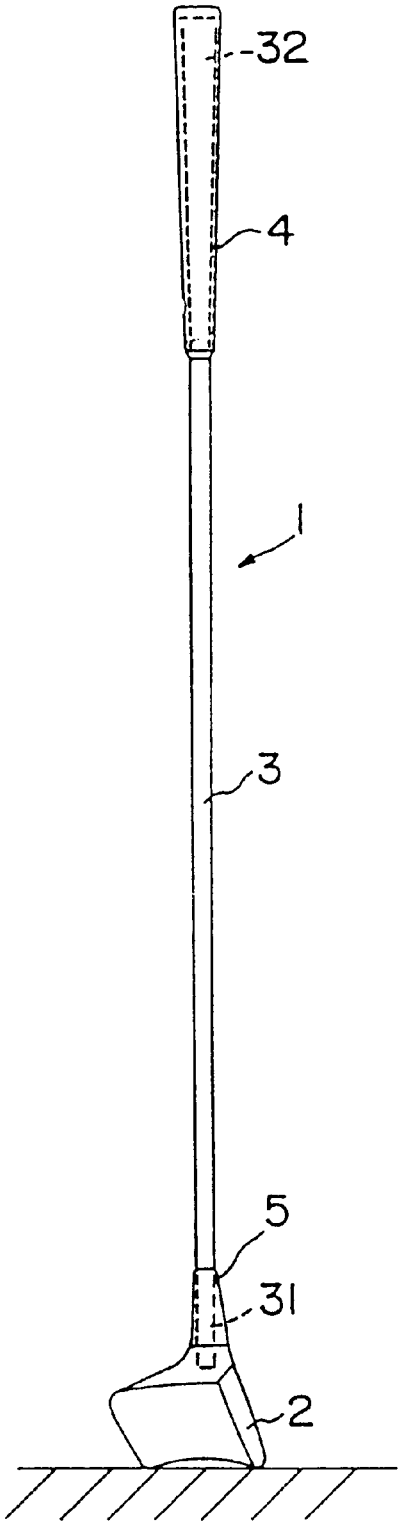
FIG. 1 is a golf club on which a shaft according to prior art is mounted.

As shown in FIG. 1, a golf club 1 generally comprises a head 2, a shaft 3, a grip or handle 4, and possibly an intermediate part 5, called a "hosel," whose main function is to reinforce the head-shaft connection. The shaft 3 is, in conventional practice, a tubular, conical object whose narrowest section is located on the side on which the head 2 of the club is attached. This end is generally termed the "tip" end 31, the other end being the "butt" 32.

Figure 2:
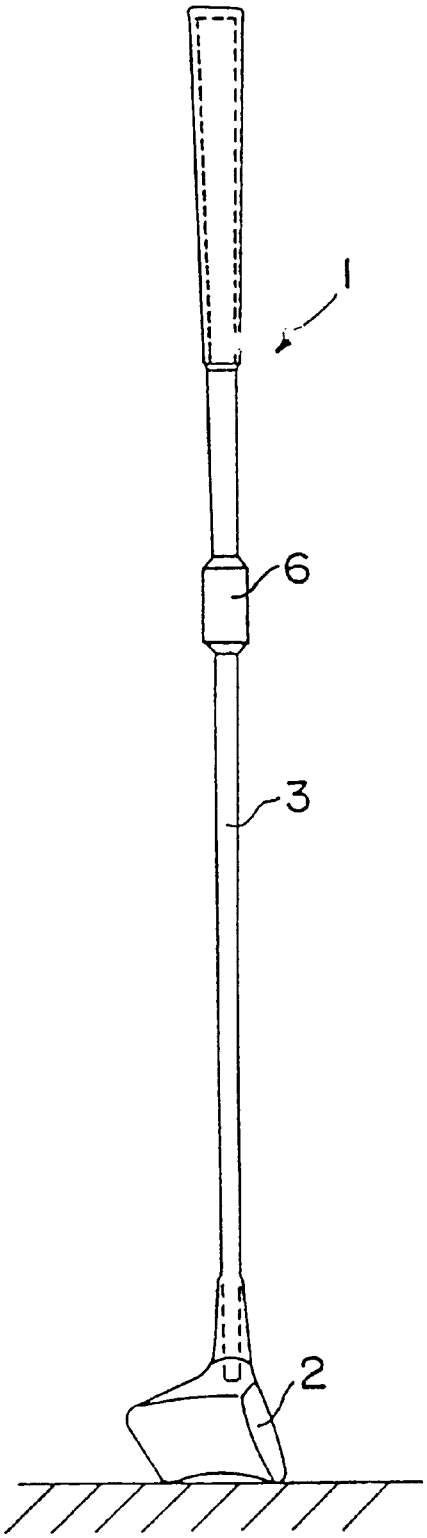
FIG. 2 represents a golf club on which a shaft according to the invention is mounted.

FIG. 2 illustrates a golf club 1 on which a shaft 3 according to the invention is mounted. In this preferred embodiment, the shaft 3 is made of composite materials, and more specifically, continuous layers of sheets of resin-impregnated fibers. Among the fibrous materials used, carbon and/or glass fibers may be mentioned. The resins are normally epoxy thermohardening resins, for example. This shaft has a slightly conical shape which widens toward the handle and is interrupted by a an enlarged area 6.

Figure 3:
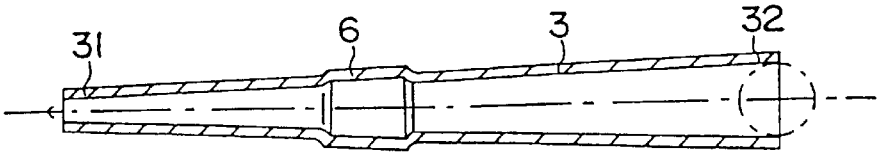
FIG. 3 represents a cross-section of a shaft according to a first embodiment of the invention.

FIG. 3 is a longitudinal cross-section illustrating the shaft in FIG. 2. It is provided over its length with an area of enlargement 6 which interrupts the slightly conical generation of the general shape. The smallest internal diameter of the shaft is located at the tip 31, i.e., at the end attached to the head 2 of the club.

Figure 4:
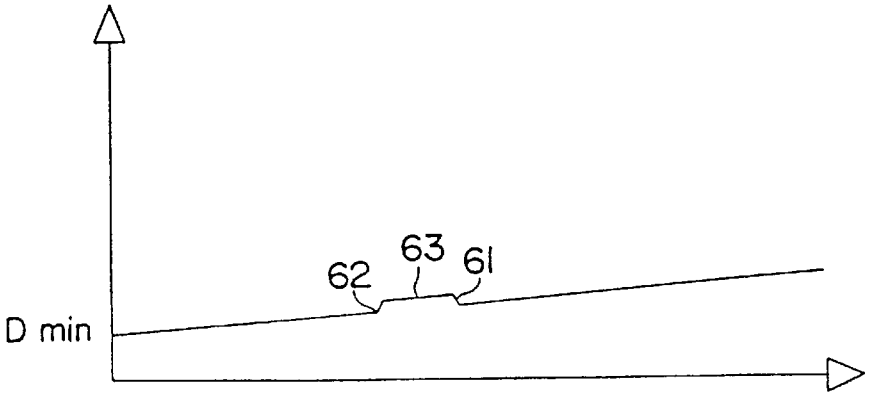
FIG. 4 represents a curve of variation of the internal diameter of the shaft as a function of the length of the latter.

FIG. 4 represents the curve of generation of the internal diameter of the shaft as a function of length. It may be noted that the area of enlargement 6 is characterized on the curve by a decreasing portion 61 preceded by an increasing portion 62. Furthermore, the slope of the increasing portion 62 is greater than the average slope of the curve external to the area of enlargement 6. Since the shaft accommodates a slight overall conicity, the curve external to the area of enlargement 6 increases in dimension and has a slight slope extending toward the end of the shaft supporting the handle. The increasing 62 and decreasing 61 portions, as shown in FIGS. 3 and 4, are connected by an attachment piece 63 whose slope is substantially equal to that of the curve external to the zone of enlargement 6. Advantageously, the slope of this portion 63 can also be approximately zero.

Finally, the shaft in FIG. 3 is formed by a stack of successive, continuous layers of fiber sheets extending mainly from one end to the other of the shaft and whose thickness varies minimally along the shaft.

Figure 5:
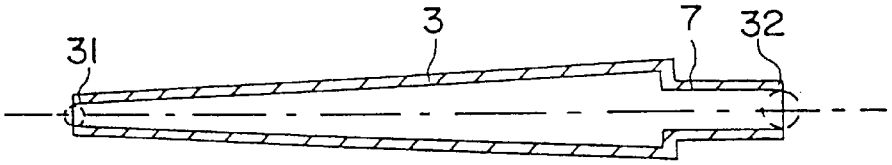
FIGS. 5, 7, and 9 are views similar to that in FIG. 3 according to variants.
Figure 6:
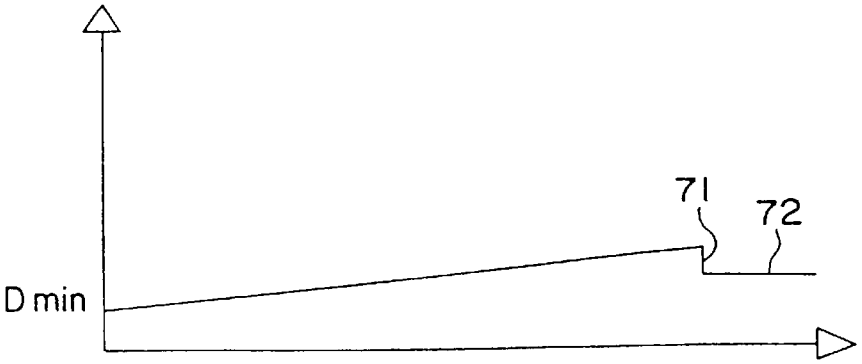
FIGS. 6, 8, and 10 show curves of variation of the internal diameter of the shaft as a function of length, corresponding to the variants in FIGS. 5, 7, and 9, respectively.

In the embodiment illustrated in FIGS. 5 and 6, the tubular shaft 3 incorporates, beginning at the "tip" end 31 having the smallest diameter, a first conical portion, which is illustrated in FIG. 6 by a slight increasing slope beginning at the point of minimum diameter (Dmin.), then an abrupt narrowing 7 on the shaft extending toward the butt end 32, as illustrated on the curve by a strongly decreasing portion 71, followed by an substantially constant portion 72.

Figure 20:
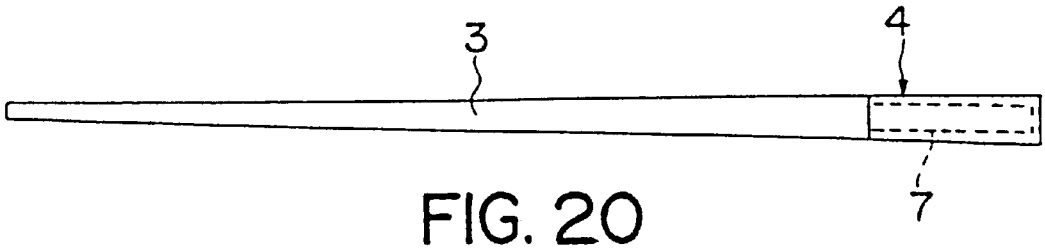
FIG. 20 represents the golf club shaft in FIG. 5 on which a grip is mounted.

This embodiment is particularly advantageous because it allows the incorporation of a grip 4 which covers and fills the narrowed zone 7. The thickness of the grip 4 is preferably chosen so that it does not exceed the depth of the narrowed zone 7, as illustrated in FIG. 20. A grip 4 incorporated flush with the rest of the shaft 3 is thus obtained.

Figure 7:
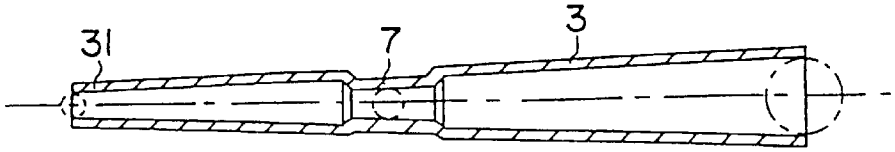
Figure 8:
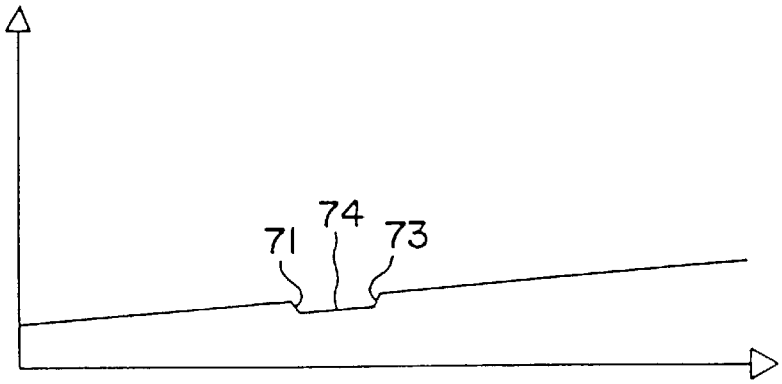

Another embodiment of the invention-illustrated in FIGS. 7 and 8, shows a shaft 3 provided over its length with a narrowed zone 7. This zone is characterized on the curve by a decreasing portion 71 preceding an increasing portion 73. Furthermore, the slope of said increasing portion 73 is greater than the average slope of the curve external to said narrowed zone 7. Finally, the decreasing portion 71 and the increasing portion 73 are advantageously connected by a connection piece 74 having a slope that is substantially zero or equal to that of the curve external to the narrowed zone 7.

Of course, the increasing 73 and decreasing 71 portions may be connected directly without a connection piece.

Figure 21:
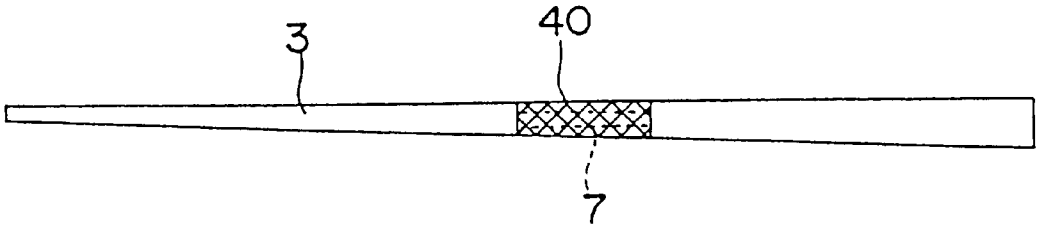
FIG. 21 represents the club shaft in FIG. 7 on which a filling ring is mounted.

In the shaft embodiment shown in FIGS. 7 and 8, advantage may be gained by specifying that the space formed by the narrowed zone 7 be filled with a filling ring 40, as shown in the shaft 3 in FIG. 21.

This ring 40 may be intended to contribute to the balancing of the club or to its dampening. Depending on the case, the ring 40 may be made of a plastic material, e.g., a material possessing viscoelastic properties, or of a metal or metal alloy.

Figure 9:
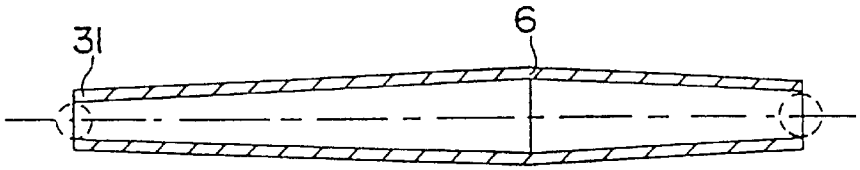
Figure 10:
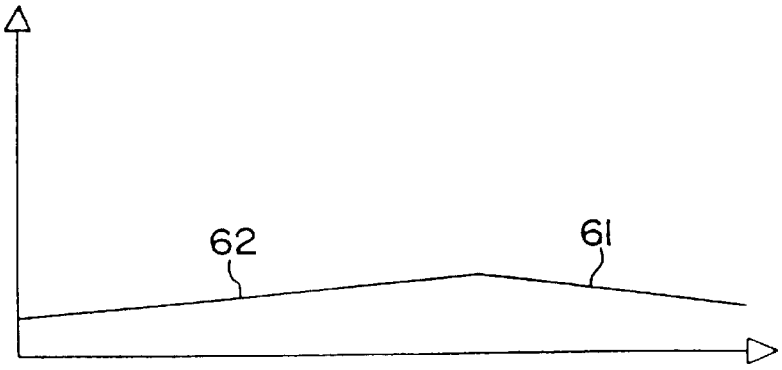
Figure 11:
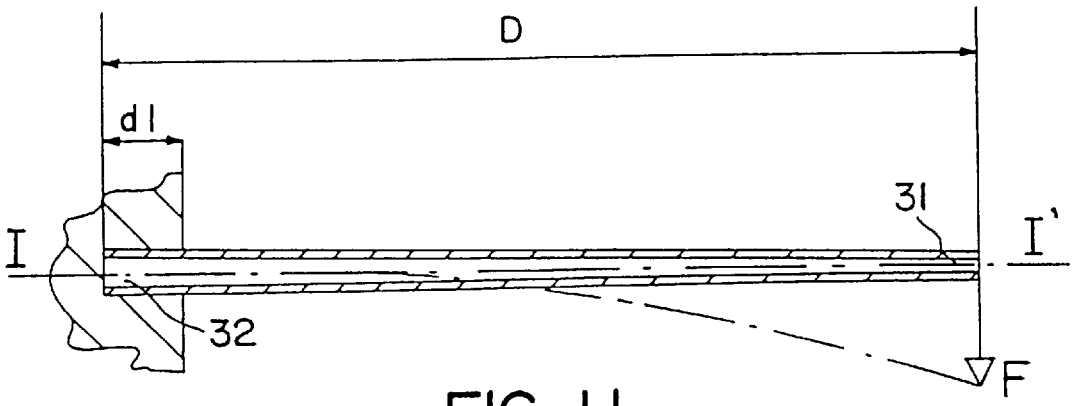
FIG. 11 is a diagrammatic representation of a cross-section of a conventional shaft which is embedded for the performance of flection tests.
Figure 12:
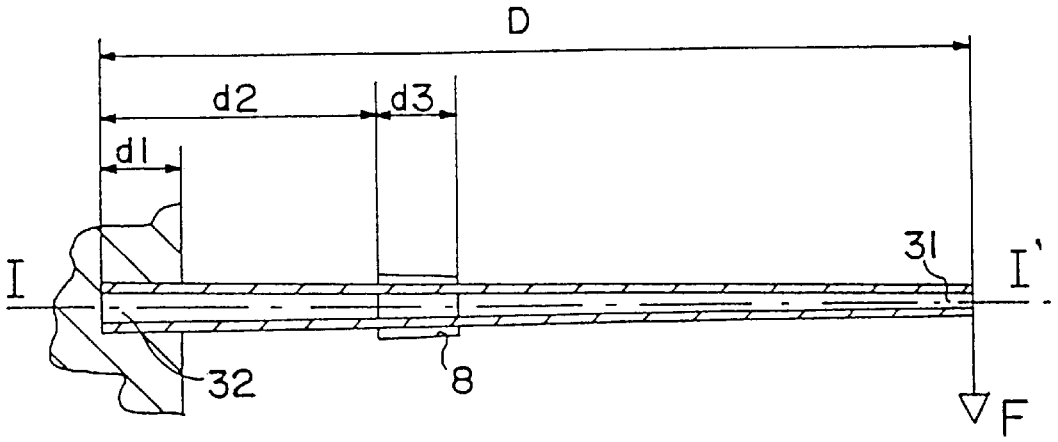
FIG. 12 represents a view comparable to that in FIG. 11, but of a conventionally-reinforced shaft.
Figure 13:
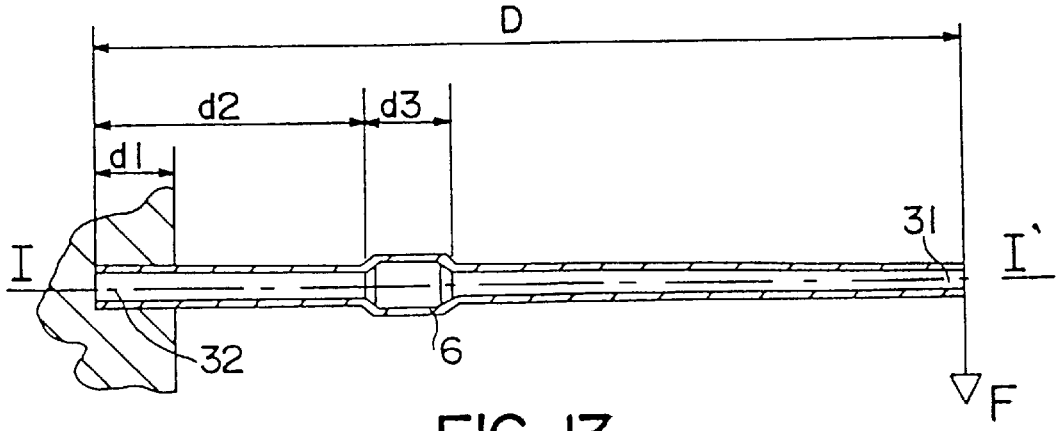
FIG. 13 represents a view comparable to that in FIG. 11, but for a shaft according to the invention which is identical to that illustrated in FIG. 2.

It may also be specified that the enlarged zone 6 is produced using a biconical shaft shape, as shown in FIG. 9. The generation of the curve in FIG. 10 shows a first increasing portion 62, to which a second decreasing portion 61 is attached. Furthermore, portions 61, 62 are, advantageously, substantially linear.

In order to understand the particularly advantageous mechanical properties of the shafts according to the invention, it is easy to use modelling to compare, as an example, the moduli of deflection f corresponding to the vertical movement of the tip end 31 of an embedded shaft having length D and stressed by means of a predetermined force F. The shaft is embedded at the butt end over a length d1.

EXAMPLE I

FIG. 11

This example concerns a conventional shaft produced from a succession of 11 layers of sheets of T300 and M40 pre-impregnated carbon fibers marketed by the TORAY company and having the following characteristics:

| | T300 | M40 |
|---|---|---|
| modulus (GPa) | 118 | 196 |
| thickness (mm) | 0.17 | 0.11 |
| density | 1.54 | 1.54 |

Among the 11 layers, 5 are turned O° in relation to the longitudinal axis (I, I') of the shaft, 3 are turned +45° and 3, −45°. The order, beginning at the interior of the shaft, is: O, +45, −45, O, +45, −45, O, +45, −45, O, O).

The conicity of the shaft in relation to axis I, I' is 0.21°.

d1 is 102 mm (embedded length) for a total shaft length of 1,057.3 mm.

F is 20.6N under pure flection.

Results: Deflection f equal 149.3 mm for a shaft weight computed to be 75.6 g.

EXAMPLE II

FIG. 12

This example concerns a conventional shaft identical to that in Example I, to which is added an excess thickness of two layers of impregnated fiber sheets so as to create an external zone of enlargement 8. This technique is conventionally applied for strengthening shafts, as described, for example, in Patent No. JP 1-259-879. The excess thickness corresponds to two layers, or 0.34 mm. It is positioned at a distance d2 equal to 298.2 mm from the butt end 32 and has a length d3 of 303.3 mm.

For a force of flection F identical to Example I, or 29.6 N), an deflection of 125.8 mm is computed for a shaft weight of 81.8 g.

EXAMPLE III

FIG. 13

This example is illustrative according to an embodiment of the invention. The shaft comprises an enlarged area 6 and is formed from 11 layers of fiber sheets arranged and turned as in Example I, and its properties are identical to the latter. The enlarged area 6 is located at the same place as in Example II (d2, d3 identical to Example II).

The total length of the shaft is also identical to the two preceding examples.

The increase of the internal radius of the shaft in the zone of enlargement 6 remains uniform and equal to 1.44 mm, as compared with the internal radius in the same area of the shaft as shown in Example II.

Thus, a deflection f of 125.8 mm is computed, i.e., a deflection equivalent to that in Example II. However, the total weight of the shaft is 78.4 g, i.e., less than weight of the shaft in Example II.

It can be stated that a lightened shaft showing uniform stiffness under flection is obtained in comparison with the conventional technique for obtaining reinforcement.

Of course, one solution according to prior art for modifying stiffness under flection without increasing weight would involve modifying the proportion by weight of the fibers to the pre-impregnated fiber resin or matrix, or changing fiber properties (reference: TORAY's T700 instead of T300); however, these solutions are costly when compared to the solution according to the invention.

One especially advantageous procedure for fabrication of shafts according to the invention may be given as a non-limiting example for the purpose of clarity of comprehension of implementation of the invention.

This process makes possible, in particular, the fabrication of shafts having complex shapes and made of continuous layers of fiber sheets.

This process involves molding the tubular shaft made of resin-impregnated fibers by exerting internal pressure in the internal volume of the shaft, so as to form the shaft on an external impression.

Thus, as shown in FIG. 14, the process consists in producing, preliminarily to the molding stage, a thin latex bladder on a form 10 by soaking the form in a bath 11 of calcium nitrate, and then of latex. After coagulation, the bladder 9 undergoes a baking procedure for approximately 10 minutes at between 70 and 80° C. After cooling, the bladder is arranged on a mandrel 12, as illustrated in FIG. 15, whose length is at least equal to that of the shaft to be manufactured. This technique makes it possible to obtain bladders of reduced thickness i.e., of approximately 0.2 to 0.3 mm.

Figure 17:
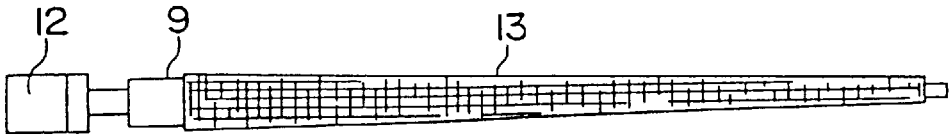

The following step (FIG. 16) consists in dressing the mandrel 12, covered with its bladder 9, with sheets of fibers 13 pre-impregnated with synthetic resins, by winding in preferably continuous multiple layers. A composite structure in the shape of a truncated cone is thus produced. A complex form, such as that illustrated in FIG. 17, is obtained prior to molding. Of course, similar results would be achieved by means of filament winding of one or multiple yarns preliminarily impregnated with resin.

Figure 18:
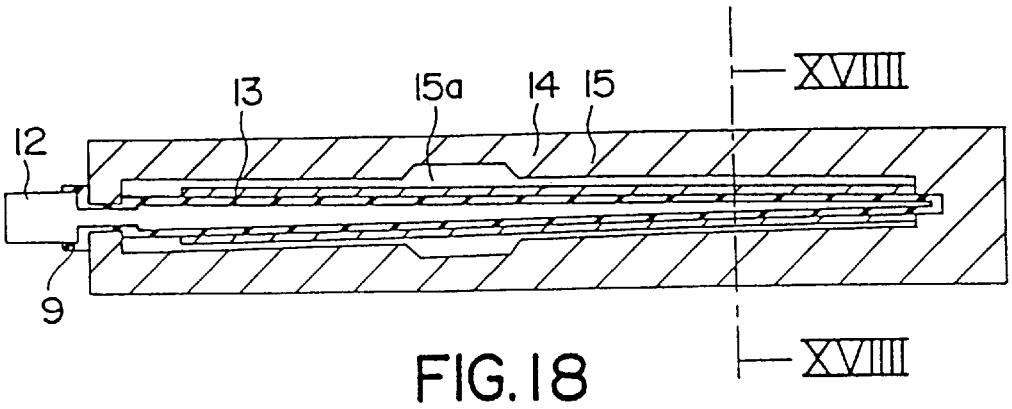
Figure 19:
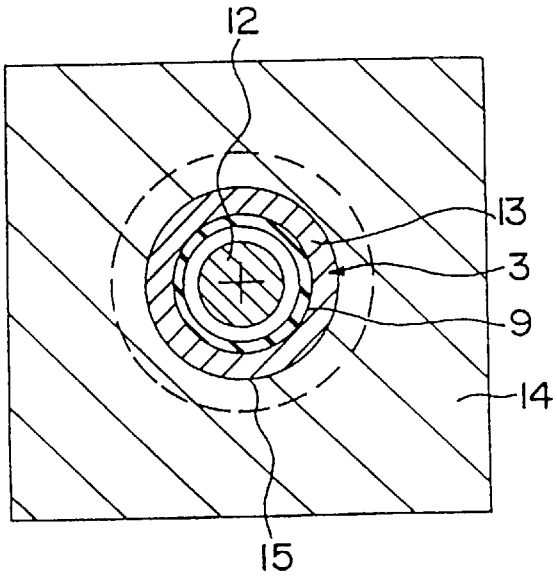

Next, in FIG. 18, the mandrel 12 is placed in a mold 14 whose impression 15 will determine the final form of the shaft to be manufactured. Thus, for example, the short area 15*a* of the mold 14 has a larger section in its central part so as to form the enlargement 6 of the final shaft 3, as shown in FIG. 2 or 3.

The molding operation is conducted by heating the mold 14 and applying internal pressure which, through gas fed to the interior of the elastic bladder 9, is exerted so as to compress the composite structure 13 on the impression 15 of the mold.

The molding cycle varies, of course, depending on the nature and reactivity of the impregnated materials used.

The specialist will know how to establish the parameters that are operational during the cycle without any special problems.

Compressed air is preferably used as the molding gas at a pressure of approximately 2.5 to 3 bars. The complex is then cooled and unmolded fairly easily, given the substantial play obtained after compression between the internal diameter of the shaft 3 and the mandrel. Further, no special surface treatment is required on the shaft finished using this technique.

What is claimed is:

1. A tubular golf club shaft made of composite materials comprising layers of fibers impregnated with plastic resin and provided over its length, with at least one area of narrowing, wherein a curve of generation of a diameter of said shaft as a function of length beginning at a point of smallest diameter and extending toward one end of said shaft incorporates a substantially cylindrical portion, and a filling ring surrounding said at least one area of narrowing, wherein said filling ring is made of a material which is different from said composite materials of said shaft and wherein said filling ring is made of a metal or a metal alloy.

2. The shaft according to claim 1, wherein said one end of said shaft is a butt end.

3. The shaft according to claim 1, including at least one conical portion extending toward a second end of said shaft.

4. The shaft according to claim 3, wherein said substantially conical portion of said shaft is separated from said substantially cylindrical portion by said at least one area of narrowing.

5. A tubular golf club shaft made of composite materials comprising layers of fibers impregnated with plastic resin and provided, over its length, with at least one area of narrowing, wherein a curve of generation of a diameter of said shaft as a function of length beginning at a point of smallest diameter and extending toward one end of said shaft incorporates a substantially cylindrical portion, and a filling ring surrounding said at least one area of narrowing, wherein said filling ring is made of a material which is different from said composite materials of said shaft and wherein said filling ring is made of a material of higher density than a density of said shaft.

6. The shaft according to claim 5, wherein said one end of said shaft is a butt end.

7. The shaft according to claim 5, including at least one conical portion extending toward a second end of said shaft.

8. The shaft according to claim 7, wherein said substantially conical portion of said shaft is separated from said substantially cylindrical portion by said at least one area of narrowing.

* * * * *